US007741782B2

(12) United States Patent
Vermeulen et al.

(10) Patent No.: US 7,741,782 B2
(45) Date of Patent: Jun. 22, 2010

(54) LIGHTING FIXTURES INCORPORATING RF ANTENNAE

(75) Inventors: Mark Vermeulen, Nuenen (NL); Cornelis J. M. Erkamp, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 208 days.

(21) Appl. No.: 11/571,576

(22) PCT Filed: Jul. 6, 2005

(86) PCT No.: PCT/IB2005/052250

§ 371 (c)(1),
(2), (4) Date: Jan. 3, 2007

(87) PCT Pub. No.: WO2006/006135

PCT Pub. Date: Jan. 19, 2006

(65) Prior Publication Data

US 2007/0252528 A1 Nov. 1, 2007

(30) Foreign Application Priority Data

Jul. 10, 2004 (GB) ..... 0415606.3

(51) Int. Cl.
*H01Q 1/26* (2006.01)

(52) U.S. Cl. ..... 315/34; 315/156; 315/157

(58) Field of Classification Search ..... 315/34, 315/149, 150, 156–158; 455/130, 899; 362/276, 362/295, 394

See application file for complete search history.

(56) References Cited

U.S. PATENT DOCUMENTS

| | | | | |
|---|---|---|---|---|
| 3,869,606 | A * | 3/1975 | Fordsmand | 362/218 |
| 4,586,115 | A | 4/1986 | Zimmerman et al. | |
| 4,985,813 | A | 1/1991 | Putman | |
| 5,192,126 | A | 3/1993 | Remeyer et al. | |
| 5,982,103 | A * | 11/1999 | Mosebrook et al. | 315/149 |
| 6,019,327 | A | 2/2000 | Negishi | |
| 6,310,440 | B1 * | 10/2001 | Lansing et al. | 315/149 |
| 6,624,845 | B2 * | 9/2003 | Loyd et al. | 348/151 |
| 7,521,872 | B2 * | 4/2009 | Bruning | 315/158 |
| 2001/0040805 | A1 * | 11/2001 | Lansing et al. | 362/276 |
| 2003/0218879 | A1 * | 11/2003 | Tieszen | 362/235 |
| 2004/0056802 | A1 | 3/2004 | Hollister | |
| 2004/0192227 | A1 * | 9/2004 | Beach et al. | 455/90.3 |
| 2004/0232849 | A1 * | 11/2004 | Roach, Jr. | 315/149 |
| 2005/0264220 | A1 * | 12/2005 | Roach, Jr. | 315/155 |
| 2008/0117110 | A1 * | 5/2008 | Luglio et al. | 343/702 |

FOREIGN PATENT DOCUMENTS

| | | | |
|---|---|---|---|
| EP | 1263150 | A2 | 12/2002 |
| GB | 2211925 | A | 7/1989 |
| JP | 09294107 | | 11/1997 |
| WO | 9813945 | | 4/1998 |
| WO | 0178190 | A1 | 10/2001 |
| WO | 03075398 | A1 | 9/2003 |

* cited by examiner

*Primary Examiner*—David Hung Vu
*Assistant Examiner*—Tung X Le

(57) ABSTRACT

A lighting fixture, such as for street lighting, comprises an external housing (11) which has a radio frequency antenna (26, 26*a*, 27) integrally formed therewith. The RF antenna enables telemanagement signals to be passed to the lighting fixture, and for the telemanagement signals to be passed between lighting fixtures in a network. The RF antenna is ideally located in or on a translucent dome portion (14) of the lighting fixture which is invariably formed from a dielectric (non-conductive) material and therefore avoids undesirable RF shielding in at least preferred directions.

14 Claims, 3 Drawing Sheets

LIGHTING FIXTURES INCORPORATING RF ANTENNAE

The present invention relates to lighting fixtures or luminaires that are fitted with an RF transmitter and/or receiver.

Increasingly, RF signalling is being used in the telemanagement of luminaires, in particular for outdoor lighting fixtures such as street lamps. To effectively transmit and receive telemanagement control signals, each lighting fixture must be provided with an antenna. The performance of each antenna must not be unduly disrupted or compromised by earthed metal parts. In many such lighting fixtures, this represents a problem for several possible reasons.

In many street lighting fixtures, metal gear trays are deployed within the lighting enclosure. These gear trays provide an earthed metal base plate onto which are mounted electrical drive components such as the lamp driver, the lamp starter, fuses and the like. These components and the gear tray are conventionally mounted within the lamp housing and effectively result in a significant RF shielding element.

Many street lighting fixtures have housings that are primarily made of metal, usually earthed, which therefore also provide substantial shielding of RF signals by acting as a Faraday cage. This means that any antenna conventionally has to be mounted outside the metal housing. The provision of an antenna outside the housing results in several design compromises that may be undesirable.

Firstly, the antenna must be connected to components that are internal to the housing by way of a suitable conduit through the housing. This requires drilling of the housing (or some other hole formation process), which may result in cracks in or damage to the housing or generally a weakness in any weather seal. This breach of the enclosure has clear implications for risking moisture ingress into the housing and resultant damage to internal components by way of corrosion, etc. Although some housings already provide a 'window' or other aperture in the top surface through which a light sensor may operate, the provision of such apertures is preferably avoided where possible for similar reasons and/or for aesthetic reasons.

Secondly, providing an antenna on the outside of a housing may also adversely impact the visual appeal of the lighting fixture, as well as possibly resulting in additional drag in windy locations.

Thirdly, if the antenna must be added externally of the lighting fixture housing after fabrication or installation of the lighting fixture, this risks improper installation and/or alignment of the antenna resulting in poor RF reception and/or transmission, as well as a higher cost and complexity of installation.

In the prior art, U.S. Pat. No. 4,586,115 describes a fluorescent lighting device in which an RF antenna is used to deliver power wirelessly to sealed fluorescent devices for use in an explosive ambient. JP 09-294107 describes a street lighting device that incorporates an RF antenna positioned for delivering highly localised radio service to an area substantially coincident with the area illuminated by the street light (e.g. for providing road traffic information to vehicles passing below). EP 1263150 describes a local radio beacon for wireless communication that is incorporated into a light bulb or into an adaptor positioned between the light bulb and a conventional domestic light socket. The lamp filament may be used as the RF antenna. WO 03/075398 describes a design of RF antenna for incorporation into a personal radio transmitter, e.g. mobile telephone.

The present invention seeks to provide a lighting fixture or luminaire that overcomes at least some or all of the above disadvantages.

According to one aspect, the present invention provides a lighting fixture including an external housing for confinement of a lamp and electrical control system, the external housing including a first portion thereof formed from electrically non-conductive material, the first portion having a radio frequency antenna integrally formed therewith.

Embodiments of the present invention will now be described by way of example and with reference to the accompanying drawings in which.

Figure 1:
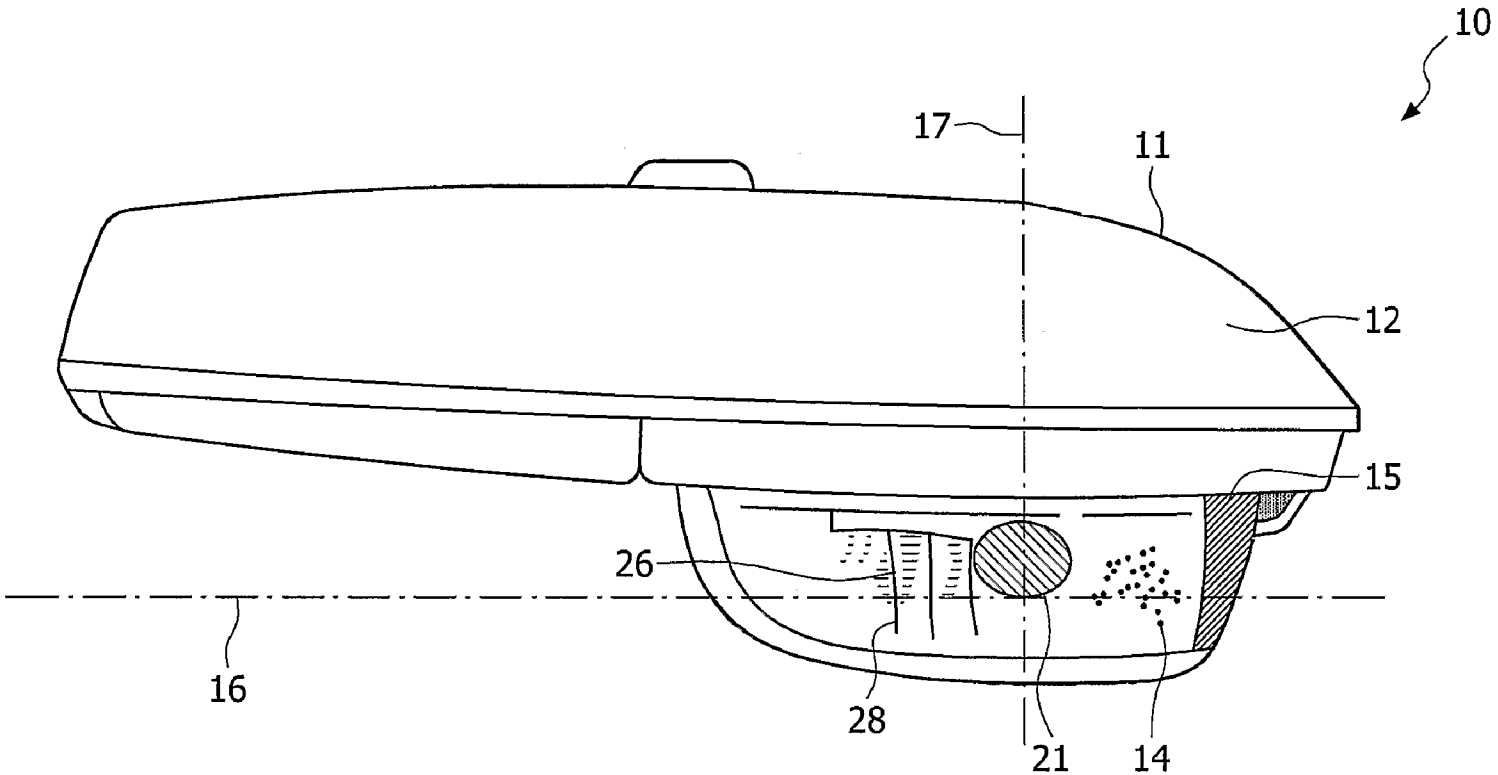
FIG. 1 is a side view of a lighting fixture incorporating an RF antenna in accordance with the invention.

Throughout the present specification, the descriptors relating to relative orientation and position, such as "upper", "lower", "horizontal", "vertical", "left", "right", "up", "down", "front", "back", as well as any adjective and adverb derivatives thereof, are used in the sense of the orientation of an exemplary lighting fixture as presented in the drawings. However, such descriptors are not intended to be in any way limiting to an intended use of the described or claimed invention.

Figure 2:
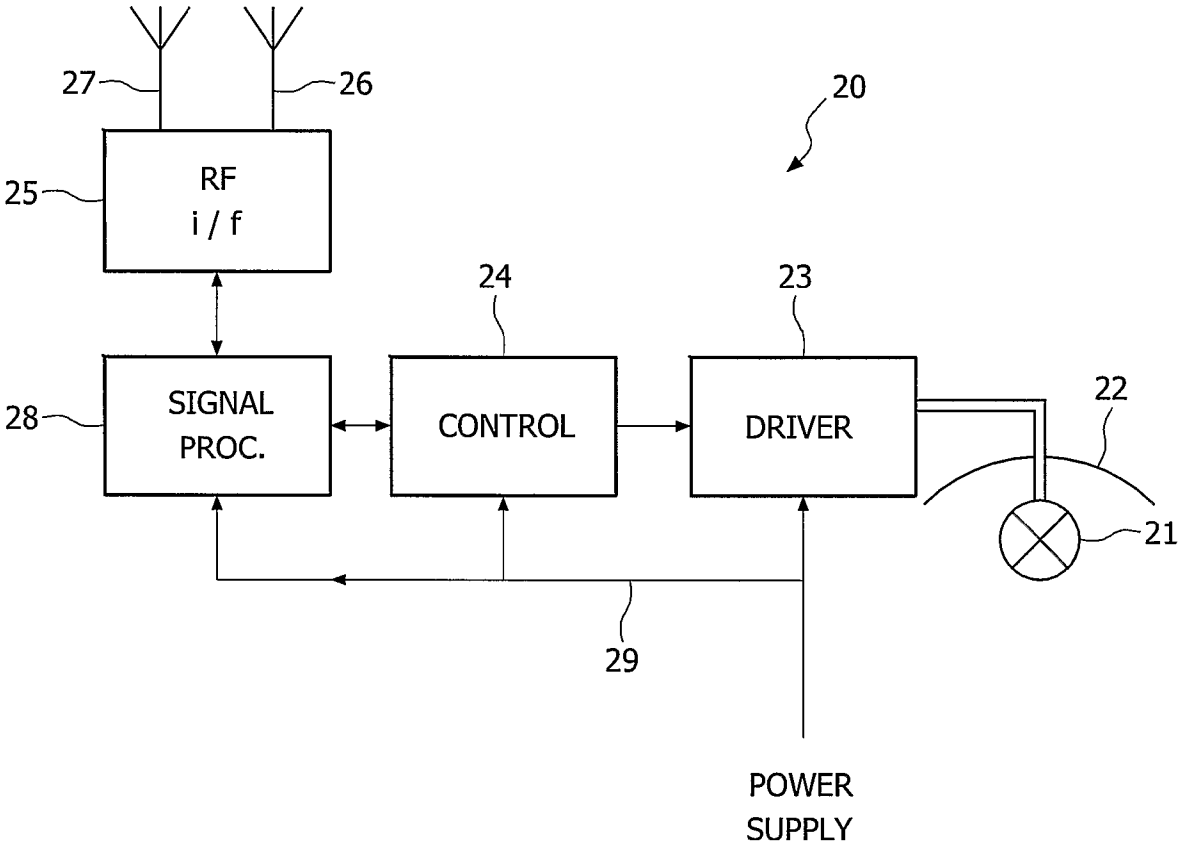
FIG. 2 is a schematic diagram of a control circuit for the lighting fixture of FIG. 1.

With reference to FIGS. 1 and 2, a lighting fixture 10, such as may be used for street lighting, comprises a housing 11 forming an enclosure for confinement of an illumination system 20, such as a lamp 21, a reflector 22 or focusing element and an electrical control system. The electrical control system may include conventional power supply devices such as a lamp driver circuit 23, a lamp starter, electrical ballast, fuses and a lamp switching control system 24.

The electrical control system also includes a radio frequency interface 25 coupled to one or more antennae 26, 27, and a signal processor 28. Each part of the system may be supplied with mains power from a common supply 29.

The housing 11 comprises an upper enclosure portion 12 fabricated from a suitable weather resistant and heat resistant material, such as metal or rugged plastics material. Where the upper enclosure portion 12 is fabricated from metal, it is preferably earthed in accordance with normal electrical installation practices. The upper enclosure portion 12 is preferably opaque to prevent light escaping therefrom in accordance with conventional light pollution and efficiency legislation as may be in force. The upper enclosure portion 12 preferably includes a mounting assembly (not shown) for retaining the principal components of the illumination system 20, e.g. the electrical control system elements 23, 24, 25 and 28, as well as the reflector 22 and a socket for receiving the lamp 21.

The housing also includes a lower enclosure portion 14 which is transparent or translucent through which optical output of the lighting fixture is directed. Preferably, the optical output is directed downwards to street level. Preferably, the lower enclosure portion 14 is fabricated from transparent polycarbonate material using an injection moulding process, although any suitable translucent weatherproof material can be used, and any suitable fabrication method can be used.

Integrally formed with the lower enclosure portion 14 is a radio frequency antenna 26 preferably in the form of an electrically conductive pattern or wire disposed on a surface of the lower enclosure 14 or embedded within the walls of the lower enclosure portion 14.

The antenna 26 preferably includes a plurality of electrically conductive elements 28 of appropriate length to correspond to an appropriate operational frequency of the RF driver circuits. Elements 28 of the antenna may be spaced at appropriate fractions of the operational wavelength (e.g. quarter lambda) for maximum transmission efficiency and, if necessary, optimum directionality. Elements 28 of the antenna 26 may extend around the lower enclosure portion 14, so that the antenna 26 presents a radiating face in two or more directions. Alternatively, two antennae 26, 27 may be provided, one on each face of the lower enclosure portion 14.

Figure 3:
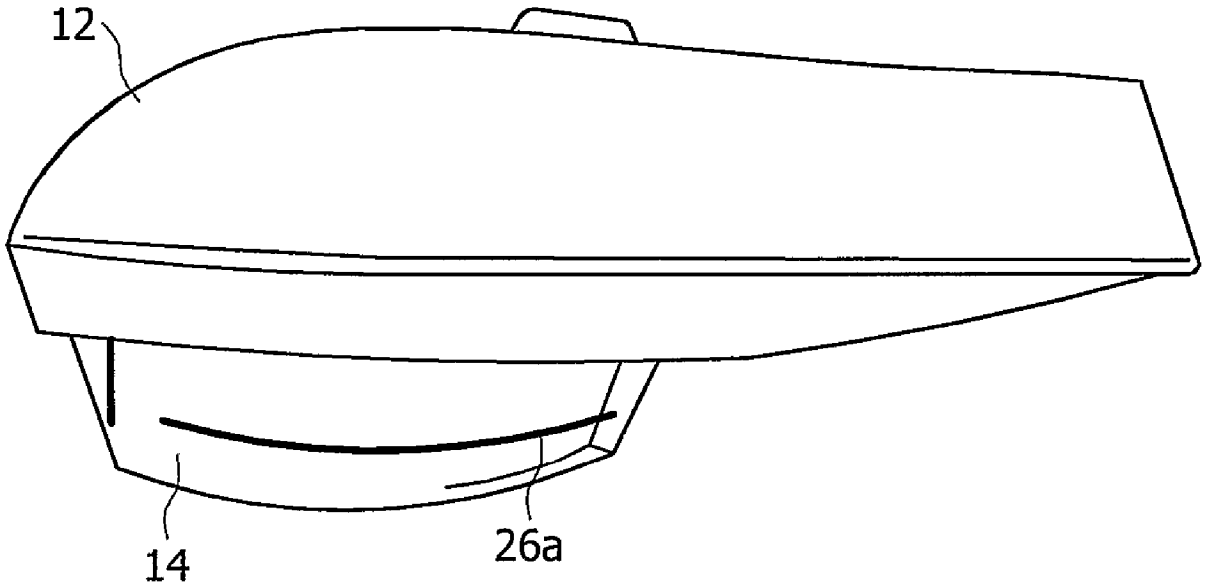
FIG. 3 is a side view of a lighting fixture incorporating a side emitting RF antenna in a dome portion in accordance with a preferred arrangement.

Another configuration of antenna 26*a* is shown in FIG. 3, particularly suited for side-emitting applications as discussed below.

The antenna 26 may be deposited on the surface of the enclosure using conventional deposition and lithographic processes, screen or ink jet printing or any other process for bonding or adhering electrically conductive elements to a dielectric material. The antenna may be deposited on the interior or exterior surface of the housing, although the interior surface is preferred. General methods of applying electrically conductive elements to the surface of a dielectric material (such as the housing 11) are known to the person of ordinary skill in the technical field.

The antenna 26 may be incorporated within the housing material during an extrusion process, or by constructing the housing in a layering process, for example. General methods of forming electrically conductive elements 28 within the body of a dielectric material (e.g. as laminates) are also known to the person of ordinary skill in the technical field.

The inventors have noted that, in conventional lighting fixtures, the lower enclosure portion 14, or 'dome' is inherently formed from a translucent plastic or other dielectric material and therefore forms a suitable substrate in or on which to form an RF antenna 26. Furthermore, such 'domes' generally extend downwardly, below a lower rim 15 of the upper enclosure portion 12 such that the dome presents a line of sight to the lamp 21 in at least two opposing directions substantially along a horizontal plane passing through or adjacent to the lamp 21.

Thus, an antenna 26, 27 formed on or in a side wall of the lower enclosure portion 14 can effectively present a radiating antenna face in a number of horizontal directions.

Considering the normal disposition of street lighting fixtures, each fixture is generally positioned atop a lamp standard at substantially similar height, and in a row following the line of the street. Thus, each lighting fixture 10 approximately occupies a common horizontal plane 16 (e.g. a plane that is substantially orthogonal to a vertical illumination axis 17 as shown in FIG. 1). It will be noted, however, that alternative axial configurations are possible.

Preferably, each antenna or set of antennae within each street lighting fixture 10 is disposed within the fixture such that it has its axis of optimum or maximal directionality in the horizontal plane 16 that is orthogonal to the illumination axis 17 and directed toward an associated transmitting or receiving unit, such as in an adjacent lighting fixture, i.e. along a line approximately parallel to the street. In the drawing of FIG. 1, the axis of optimum or maximal directionality would preferably be substantially orthogonal to the plane of the paper.

This is readily possible by forming the antennae 26 in or on a side wall of either the upper or lower enclosure portions 12, 14, such as the side wall which is presented in the view of FIG. 1. It will be understood that a second antenna 27 (or further elements of the same antenna 26) are preferably positioned on the opposite side wall (not visible in FIG. 1).

In this fashion, a street lighting system can be implemented in which a plurality of lighting fixtures 10 are disposed in a row, each fixture having respective antennae positioned with the radiating faces thereof directed towards adjacent ones of the lighting fixtures 10. In this manner, each one of the lighting fixtures can form a node in an RF-connected network. Each lighting fixture 10 may include the switching control circuit 24 for switching the lamp 21 within the lighting fixture, based on telemanagement signals received over the network. Each lighting fixture 10 also includes the signal processor 28 coupled to the radio frequency interface 25 adapted to receive those telemanagement control signals and pass the telemanagement control signals both to the local switching control circuit 24 and also to adjacent lighting fixtures 10 in the network by way of the RF interface 25 and antenna 26 or 27.

It will be noted that, because the street lighting fixture position and orientation is particularly determined with reference to a line of the street and the height of a lamp standard, the positioning of directional or bidirectional antennae 26, 27 in the housing 11 during manufacture advantageously automatically results in a high degree of antenna alignment between lighting fixtures after installation of the lighting fixture. Thus, it is not necessary for lighting installation engineers to individually position and tune antennae 26, 27 for optimum signal strength between lighting fixtures.

The antennae 26, 27 need not be highly directional. Omnidirectional antennae may be used, in particular for lighting fixtures 10 that are not necessarily intended for linear disposition on a street, e.g. around a courtyard or square.

It will be understood that, where the upper enclosure portion 12 is not formed from an electrically conductive material (e.g. metal), the antennae 26, 27 could be disposed in or on the upper enclosure portion 12 rather than the transparent lower enclosure portion 14. Such an arrangement may have a minor disadvantage if there are a significant number of internal earthed components that provide significant RF shielding in the horizontal plane 16. If so, this disadvantage may be overcome by positioning separate antennae 26, 27 on two or more sides of the upper enclosure portion 14.

Although domes 14 that extend downwardly as described above may provide the most efficient side-emitting antennae, other dome shapes, including flat or curved glass which are commonplace may be used to accommodate an antenna and still offer significant benefits for communication from the fixture to another RF appliance.

Although the invention has been described as particularly advantageous in the context of street lighting, it will be understood that it may also have application in any form of indoor or outdoor luminaire, e.g. as used in large indoor complexes such as public buildings or shopping malls.

Other embodiments are intentionally within the scope of the accompanying claims.

The invention claimed is:

1. A lighting fixture including an external lamp housing for confinement of a lamp and an electrical control system, the external lamp housing including:

a first lower enclosure portion thereof formed from electrically non-conductive material, the first lower enclosure portion forming a suitable substrate for a radio frequency antenna which is integrally formed therewith preferably in the form of an electrically conductive pattern or wire disposed on or in a sidewall of the first lower enclosure portion, the radio frequency antenna including a plurality of electrically conductive elements of appropriate length to correspond to an appropriate operational frequency of an RF driver circuit, wherein each element is spaced at appropriate fractions of the operational wavelength for maximum transmission efficiency; and wherein the first lower enclosure portion is formed from a translucent material through which optical output of the lighting fixture is directed such that the lower enclosure portion presents a line of sight to the lamp in at least two opposing directions substantially along a horizontal plane passing through or adjacent to the lamp, and a second substantially opaque portion confining the electrical control system of the lighting fixture.

2. The lighting fixture of claim 1 in which the opaque portion is formed from metal.

3. The lighting fixture of claim 1 in which the first lower enclosure portion has a profile that allows line of sight to the lamp within the housing in at least two opposing directions.

4. The lighting fixture of claim 1 in which the antenna is configured to provide a high degree of directionality in a plane substantially orthogonal to an illumination axis.

5. The lighting fixture of claim 4 in which the antenna is configured to provide a high degree of directionality in two opposite directions in the plane.

6. The lighting fixture of claim 1 in which the first lower enclosure portion is formed from injection moulded polycarbonate material.

7. The lighting fixture of claim 1 in which the antenna is formed from a thin electrically conductive wire fixed into or onto the first lower enclosure portion.

8. The lighting fixture of claim 1 in which the antenna is embedded within the first lower enclosure portion.

9. The lighting fixture of claim 1 in which the first lower enclosure portion defines a dome shape extending from a lower rim of the opaque portion, such that the antenna is unshielded in at least a horizontal plane extending through the antenna.

10. The lighting fixture of claim 1 further including an RF transceiver and a lamp control device coupled thereto, for receiving RF switching control signals and to control switching on and off the lamp within the lighting fixture in accordance with the control signals.

11. The lighting fixture of claim 1 further including an RF transceiver for receiving signals from and transmitting signals to plural adjacent lighting fixtures.

12. The lighting fixture of claim 1 incorporated within a streetlight.

13. A street lighting system incorporating a plurality of lighting fixtures according to claim 1, the lighting fixtures being disposed in a row and presenting respective antenna, such that the radiating faces thereof are directed to adjacent ones of the lighting fixtures.

14. The street lighting system of claim 13 in which each one of the plurality of lighting fixtures forms a node in an RF connected network, each comprising a switching control circuit for receiving switching control signals and passing said switching control signals to an adjacent lighting fixture in the network.

* * * * *